United States Patent [19]

Bardsley et al.

[11] Patent Number: 4,804,550

[45] Date of Patent: Feb. 14, 1989

[54] METHOD FOR PACKAGING GROUND COFFEE

[75] Inventors: Robert F. Bardsley, Harrington Park; Eugene E. Corrigan, Edison, both of N.J.

[73] Assignee: Tetley Inc., Palisades Park, N.J.

[21] Appl. No.: 939,957

[22] Filed: Dec. 10, 1986

[51] Int. Cl.[4] ..... B65B 1/22; B65B 1/24

[52] U.S. Cl. ..... 426/397; 53/436; 53/437; 53/525; 53/527; 141/12; 141/73; 141/74; 141/80; 426/404; 426/111; 426/131; 220/70

[58] Field of Search ..... 426/131, 111, 397, 404, 426/414, 411, 106; 53/432, 438, 439, 436, 433, 510, 511, 523, 525, 527, 437; 141/12, 73, 74, 80, 77

[56] References Cited

U.S. PATENT DOCUMENTS

| | | | |
|---|---|---|---|
| 290,013 | 12/1883 | Elder . | |
| 291,683 | 1/1884 | Chapman . | |
| 1,162,520 | 11/1915 | Shaffer | 426/395 |
| 2,012,213 | 8/1935 | Young | 426/131 |
| 2,046,366 | 7/1936 | Collins | 53/436 |
| 2,110,012 | 3/1938 | Auban | 426/413 |
| 2,120,906 | 6/1938 | Moore . | |
| 2,338,012 | 12/1943 | Schmitt | 53/432 |
| 2,423,358 | 7/1947 | Wheaton et al. | 53/436 |
| 2,496,877 | 2/1950 | Krueger | 53/432 |
| 2,894,844 | 7/1959 | Shakman | 426/397 |
| 3,056,244 | 10/1962 | Bartels | 53/432 |
| 3,105,765 | 10/1963 | Creegan | 426/131 |
| 3,117,873 | 1/1964 | Bartels et al. | 426/131 |
| 3,405,744 | 10/1968 | Bowman | 53/436 |
| 3,517,475 | 6/1970 | Balocca | 53/432 |
| 3,704,140 | 11/1972 | Pettit et al. | 426/131 |
| 4,098,404 | 7/1978 | Markert | 426/404 |
| 4,125,632 | 11/1978 | Vosti et al. | 426/111 |
| 4,154,045 | 5/1979 | Christensson | 53/436 |
| 4,408,440 | 10/1983 | Van Kesteren . | |
| 4,411,122 | 10/1983 | Cornish . | |
| 4,459,793 | 7/1984 | Renger | 426/404 |
| 4,688,369 | 8/1987 | Cornish et al. | 53/438 |

FOREIGN PATENT DOCUMENTS

| | | | |
|---|---|---|---|
| 466003 | 5/1937 | United Kingdom | 426/397 |
| 1412688 | 11/1975 | United Kingdom | 426/398 |

*Primary Examiner*—Steven Weinstein

*Attorney, Agent, or Firm*—St. Onge Steward Johnston & Reens

[57] ABSTRACT

A technique is described by which a predetermined amount by weight of ground coffee can be packaged into a container while the coffee density may vary within a range. The amount of ground coffee is supplied into a container along a feed path to fill the container and form a column that extends above the upper rim of the container. The ground coffee is compressed to a predetermined head level by compressing a region around the feed path while leaving a small column of uncompressed coffee. In another embodiment, the volume of the container is expanded during compression by outwardly deforming a container end. This enables the stiffening of the ground coffee to support a smooth unbeaded outer wall after vacuum packing without paneling effects.

33 Claims, 3 Drawing Sheets

ACTU-
ATOR 20
30
24
64
62
19
34

20
30
24
48
70
62
19
34

20
30
24
64
40
44
28
46
34

64
62
60
19

METHOD FOR PACKAGING GROUND COFFEE

FIELD OF THE INVENTION

This invention generally relates to the packaging of granular food materials such as roasted ground coffee and more specifically to a method, apparatus and container for packaging ground coffee.

BACKGROUND OF THE INVENTION

In the manufacture and packaging of ground coffee, the roasted coffee beans are ground into the well-known granular form and then dispensed into individual coffee cans at a weighing and filling station placed along a coffee production line. Empty coffee cans are transported past the station where predetermined amounts by weight of coffee, typically one pound, are delivered into open cans. During such filling, the cans are vibrated to settle the coffee and thus, more densely package the ground coffee in the can.

Since the shelf life of coffee deteriorates in the presence of oxygen, the filled coffee cans are passed into a vacuum chamber where air is removed and a lid applied over the opening to thus vacuum-pack the ground coffee. In such coffee packing, it is desired to keep the free head space in each can as small as possible while still being able to accommodate a pound of coffee in a standard one pound can with different ground coffee densities.

Coffee density variations arise by virtue of the nature of the coffee beans themselves, the grinding process, and the handling of the ground coffee during the packing process. Some control over coffee density can be exercised during grinding, but such control is not always sufficient to assure that a pound of coffee will fit into a standard one pound can.

Coffee cans can be made larger to accommodate low density coffee, but then the cans designated for a particular weight will vary in size and the cans become more expensive. As a practical matter, therefore, low coffee densities are difficult to accommodate.

Initially after ground coffee has been vacuum-packed, the vacuum inside the can results in large atmospheric forces on the can wall. After some time, however, gases are released from the ground coffee and provide sufficient internal pressurization to counterbalance atmospheric pressure. One could, therefore, use a smooth-walled can and hold it in a vacuum until these internal gases build up. This, however, is not practical with typical ground coffee packaging lines where thousands of cans are processed in short time intervals.

Conventional coffee cans, therefore, are provided with regularly-spaced horizontal annular beads. These beads serve to strengthen the can wall and avoid its partial collapse, known as paneling, arising right after vacuum packing. Paneling problems become particularly frequent when the can wall is made very thin or when the can beads are eliminated. Elimination of beads is desirable to improve can appearance and enable use of other can materials such as plastic.

Techniques have been described to utilize the ground coffee to provide sidewall support in a vacuum packing process. For example, in U.S. Pat. Nos. 3,056,244 and 3,517,475, an uncontrolled pile of ground coffee is formed in the can and is then compressed after the coffee can has been vacuum packed by shortening or collapsing the can body. The compression provides a counterbalancing force against paneling of the coffee can. In U.S. Pat. No. 3,117,873, the ground coffee is compressed by bowing-in the can lid, thus reducing the volume of the can.

These coffee compressions techniques do not handle density variations and may, therefore, not function satisfactorily. Problems are encountered when the ground coffee is excessively compressed so as to form in essence a rigidity that resists easy dispensing when the coffee can is opened by a consumer.

SUMMARY OF THE INVENTION

With a technique in accordance with the invention, large ground coffee density variations can be accommodated so as to fit a predetermined weight of coffee into a standard can size substantially without spillage. A smooth-walled container can be used with internal wall support provided by a controlled compression of a ground coffee.

This is obtained with one technique in accordance with the invention by selecting a container volume so that it cannot accept the total charge of predetermined amount of weight of ground coffee. As a result, the product extends into a retainer that rests on the upper rim of the ground coffee container. Part of the ground coffee is thus stored outside the container in a column that rests upon the ground coffee that is inside the container. A piston is then applied to compress the coffee in the retainer to a predetermined head level inside the container.

The amount by which the ground coffee in this manner can be compressed is sufficient to accommodate a range of commonly encountered ground coffee densities without excessive compression of the coffee.

In a further enhancement of the ground coffee filling technique of this invention, an end of the coffee can is made so as to be deformable in an outward direction. Hence, when a very low density or light weight ground coffee is encountered, it also can be compressed to fit into the can without excessive compression because the can volume is expanded during compression by an outward collapse or deformation of the can end. In addition, a straight thin-walled container can be used which is internally re-enforced by compressed coffee without excessive rigidizing of the coffee.

A ground coffee filling technique in accordance with the invention is particularly adaptable for use at a weighing and filling station that is located along a production line. Empty cans are transported past the station where metered amounts, typically one pound quantities, simultaneously are entered into a number of cans along feed paths that extend through the pistons used to compress the coffee. The cans at the station are vibrated during filling, and each can is provided with a ground coffee column that is outside the can. At the end of the filling cycle, the ground coffee in each column is compressed into its associated can. The compression is done with annular pistons while leaving small uncompressed portions of the metered amounts in columns surrounded by the pistons. The compression pressure is sufficient to compress the coffee to a predetermined head level so that the uncompressed ground coffee portion that is stored in a column inside the piston can be delivered and fit inside the can without spillage during subsequent processing.

It is, therefore, an object of the invention to provide a method, apparatus, and container with which ground coffee can be delivered substantially independent of density variations and without spillage of coffee during filling and subsequent transport to a vacuum packing operation. It is a further object of the invention to provide a smooth-walled container in which ground coffee can be vacuum-packed without paneling effects.

These and other objects and advantages of the invention can be understood from the following detailed description of several embodiments of the invention with reference to the drawings.

DETAILED DESCRIPTION OF DRAWINGS

Figures 1A, 1B, 1C, 1D, 1E:
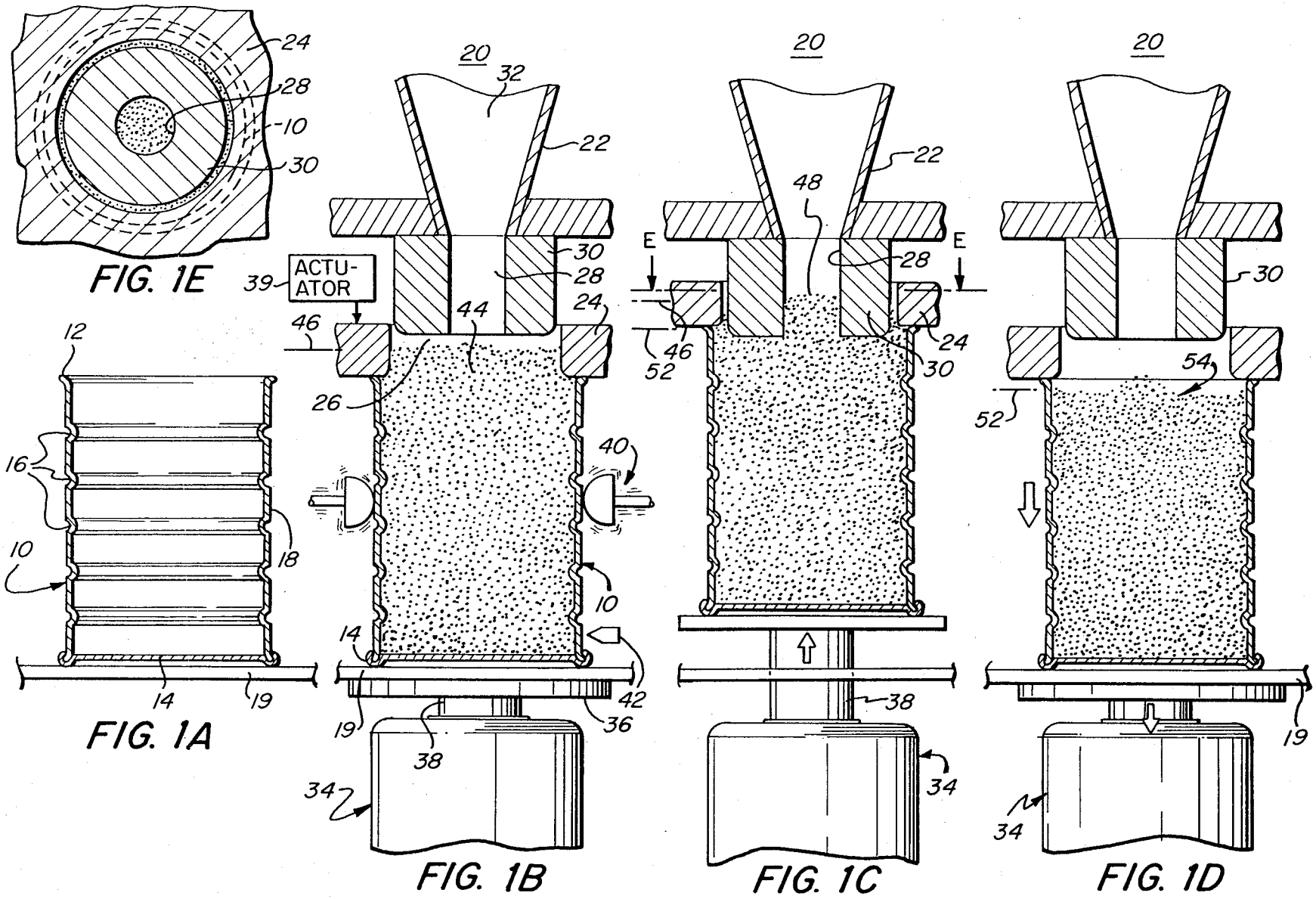
FIGS. 1A, 1B, 1C and 1D are vertical section views of equipment and cans used in sequential steps in the filling of a conventional coffee can in accordance with the invention.
FIG. 1E is a section view taken along the line E—E in FIG. 1C.

With reference to FIGS. 1A–1D, a conventional coffee can 10 is shown with an open end 12 and a closed end 14. The can has horizontal beads 16 to strengthen the side wall 18 against atmospheric collapse after a vacuum packing operation (not shown). The coffee can is made of metal or such other material as may be suitable.

The views of these Figures depict the processing of a single coffee can, though in practise a number of coffee cans are simultaneously filled with ground coffee in accordance with the invention and a continuous flow of coffee cans are handled.

The coffee can 10 is transported by a suitable conveyor mechanism 19 (partially shown) to a filling station 20 where a metered amount of ground coffee is delivered to can 10. Station 20 includes a coffee weighing and delivery system with which a predetermined amount by weight of ground coffee is delivered through a funnel 22 to the empty coffee can 10. Station 20 includes a retainer bar 24 in the form of a ring that has a through bore 26 that is slightly smaller in crossection than open end 12. During filling and compression, ring bar 24 effectively rests on the perimeter of open end 12 and thus provides in effect a temporary extension of the can volume.

Funnel 22 terminates at a central bore 28 of an annular piston 30 affixed to the lower end of funnel 22. Hence, ground coffee 32 is delivered into can 10 along a feed path that includes funnel 22, bores 28 and 26 into can 10. Piston 30 has an outside dimension which enables easy clearance through bore 26 into coffee can 10.

Station 20 includes a compression mechanism 34 in the form of a hydraulic actuator having a drive plate 36 that can be hydraulically pushed up by a piston rod 38 against can end 14 to lift can 10 against the piston 30 as illustrated in FIG. 1C. Ring bar 24 is mounted so as to freely move up and down with can 10 as this is raised and lowered by piston 36, thus keeping a perimeter seal with can 10. Movement of ring bar 24 is controlled with an actuator 39 that senses when a can 10 is in place so as to release and lower onto the can and raise bar 24 when can 20 has been filled with ground coffee.

A vibrating mechanism 40 is employed to vibrate can 10 as it is filled with roasted ground coffee.

In the operation of the ground coffee filling station 20, empty coffee cans 10 are transported to station 20 where predetermined amounts of ground coffee are weighed and await delivery into cans 10. The mechanism for metering predetermined amounts by weight is well known and, therefore, is not shown.

When a coffee can 10 is positioned below funnel 22, a sensor 42, that can be a mechanical lever or optical sensor or the like, detects this, causes a lowering or release of ring bar 24 and initiates a filling cycle. This includes actuation of the vibrator 40 and opening of a suitable slide valve (not shown) to allow the predetermined amount by weight of ground coffee to flow through funnel 22 and along a feed path formed by bore 28 in piston 30 into can 10. The vibration of can 10 tends to settle the coffee more densely into can 10. The ground coffee fills can 10 and extends with a spacially-controlled column 44 up into bore 26 of retainer 24 to a level 46 that is above open end 12 of can 10. The height of level 46 varies with the density of the ground coffee. The crossectional dimensions of column 44 are substantially the same as those of can 10.

At a time when all of the ground coffee has been delivered, the hydraulic actuator 34 is operated and thus causes the coffee in can 10 to be pressed against piston 30 while a portion 48 of the ground coffee is still outside can 10 within bore 28 as shown in FIG. 1C.

The actuator 34 is energized so that ground coffee is compressed to a level 52 inside can 10. Level 52 is selected such as to be just below the can opening 12, yet sufficiently below it to form a can head space into which the column 48 of uncompressed ground coffee can flow after the can 10 has been lowered by actuator 34 as shown at 54 in FIG. 1D.

The advantage of using a ring-like piston 30 can be appreciated since this enables filling and compression of ground coffee at the same station 20. The standard ground coffee may be in a range that extends from as low as about 17 lbs./ft.$^3$ to as high as about 22 lbs./ft$^3$. Normally, densities below 17.5 lbs./ft.$^3$ are rare while densities above about 19.5 lbs./ft.$^3$ can be accommodated with little compression. The height of the fill level 46 is preferably for the light weight coffee whose volume reduction of about 10 percent will be sufficient to achieve the compressed head level 52.

The magnitude of the compression is limited by a maximum allowable compression of the ground coffee where it would become as hard as a brick and thus difficult to dispense. This maximum compression arises at a pressure level of the hydraulic actuator (using a 2½ inch diameter cylinder) approaching about 1,000 psi. Generally, a pressure of about 300 psi provides sufficient compression to accommodate low density ground coffee. Note that compression by a ring-shaped piston 30 does not force coffee up into bore 28 and the portion stored in column 48 remains essentially undisturbed.

After compression, actuator 38 is operated to lower can 10 as shown in FIG. 1D so that the portion 48 of ground coffee can be gravity fed freely onto the compressed coffee into the can 10. This then yields a ground coffee-filled can with a small head space and which can retain a predetermined weight of low density ground coffee without spillage during subsequent handling.

FIGS. 2A–2D illustrate a further technique of the invention whereby the container 60 is fully-packed with product and can use a light-weight plate material without beads. This is obtained with a cylindrical open can 60, having an outwardly collapsible can end 62 and a smooth outer wall 64. End 62 is, as also shown in FIG. 3, made of a suitable outwardly deformable material with inwardly stepped annular platforms 66 and a top central segment 68. End 62 can respond to pressures from compressed coffee with an outward movement so as to expand the volume of can 60.

Figures 2A, 2B, 2C, 2D:
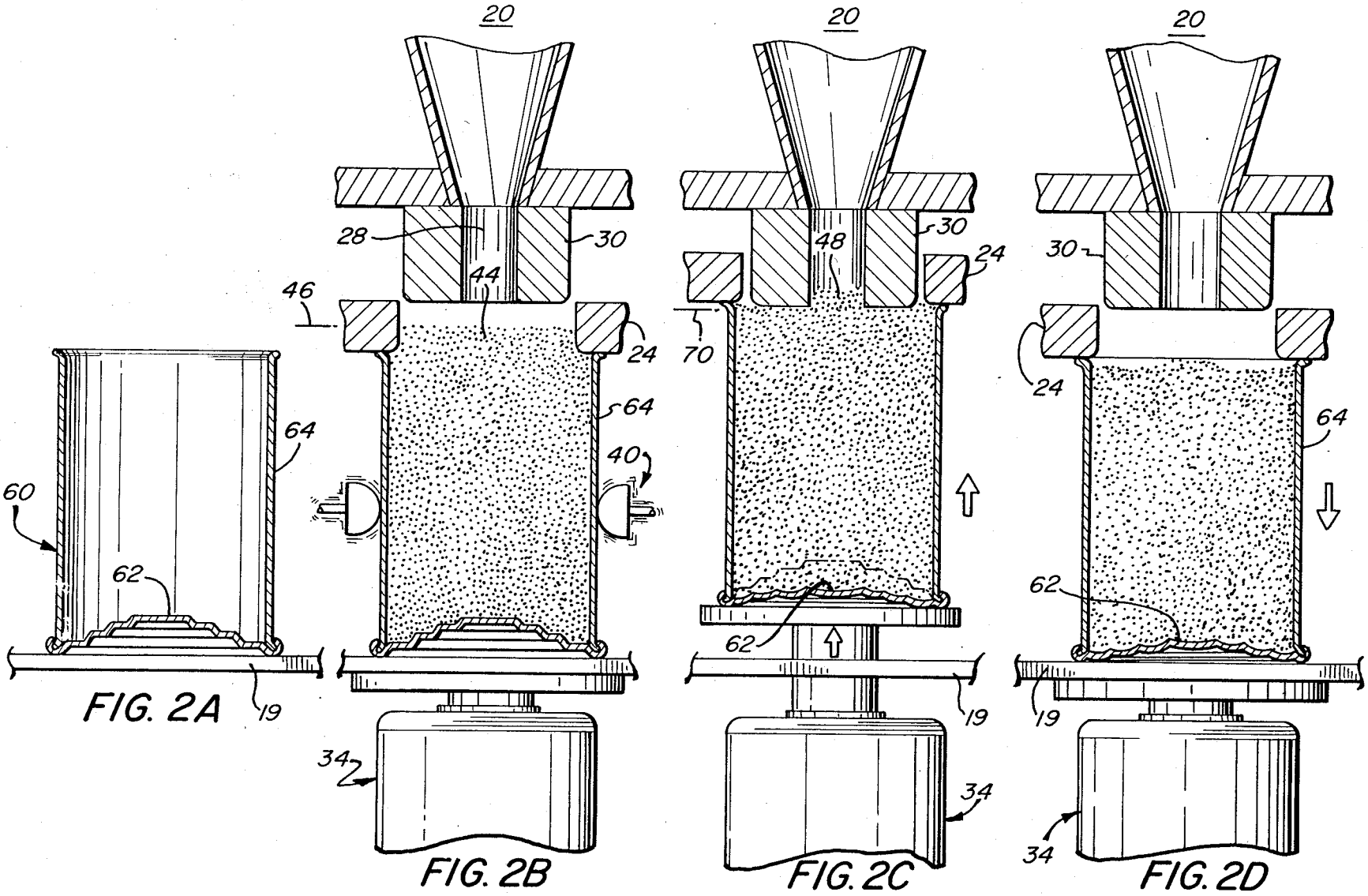
FIGS. 2A, 2B, 2C and 2D are vertical section views of sequential steps in a filling of a coffee can in accordance with the invention.
Figure 3:
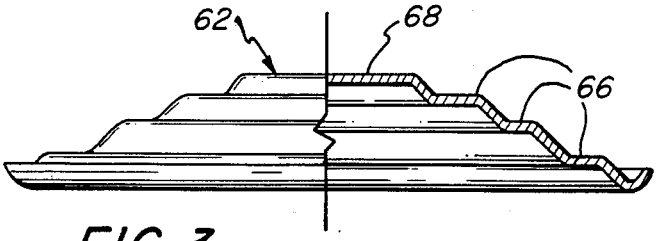
FIG. 3 is a partial section view of a can end used with the coffee can shown in FIGS. 2A–2D.

The filling of can 60 with ground coffee can be done in the manner as illustrated in FIGS. 2B–2D that is similar to the technique shown and described with reference to FIGS. 1B–1D. In the embodiment of FIG. 2, however, the compression step shown in FIG. 2C is carried out to a pressure level whereby the ground coffee is sufficiently rigidized to compress and rigidize the container wall 64 and prevent collapse and paneling effects after vacuum packing.

In FIG. 2B the ground coffee is delivered to container 60 to a higher fill level at 68. Compression is then carried out to a sufficient extent so as to rigidize the ground coffee which stiffens the container in all directions. The coffee density may vary and result at low values in occupying a larger volume. In such case, end 62 enables compression of the ground coffee to a head level 70 by collapsing when the coffee is compressed as shown in FIG. 2B.

In this manner, excessive compression forces can be avoided and the ground coffee can be compressed to a head level sufficient to stiffen the coffee for side wall support independent of density variations.

The compression forces in the techniques of FIGS. 2A–2D are higher than those needed for the technique described with reference to FIGS. 1A–AD. Pressures in the range of about 250 to 400 psi from a 2½ inch hydraulic cylinder were needed to effect sufficient compression and stiffening of the coffee. Density variations of the order of about 15 percent were accommodated without deterioration of the ground coffee.

Figure 5:
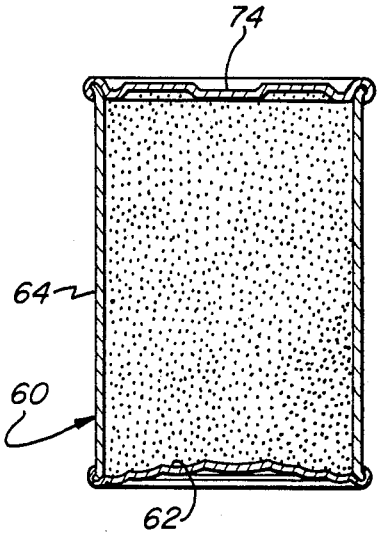
FIG. 5 is a section view of a vacuum packed coffee can formed in accordance with the invention.

After the coffee can has been compressed, the can 10 is provided with a lid 74 as shown in FIG. 5 in a vacuum packing operation. Can 10 emerges with its sidewall 64 undeformed because of the stiffened coffee inside the can. End 62 is somewhat deformed to provide additional can volume.

Figure 4:
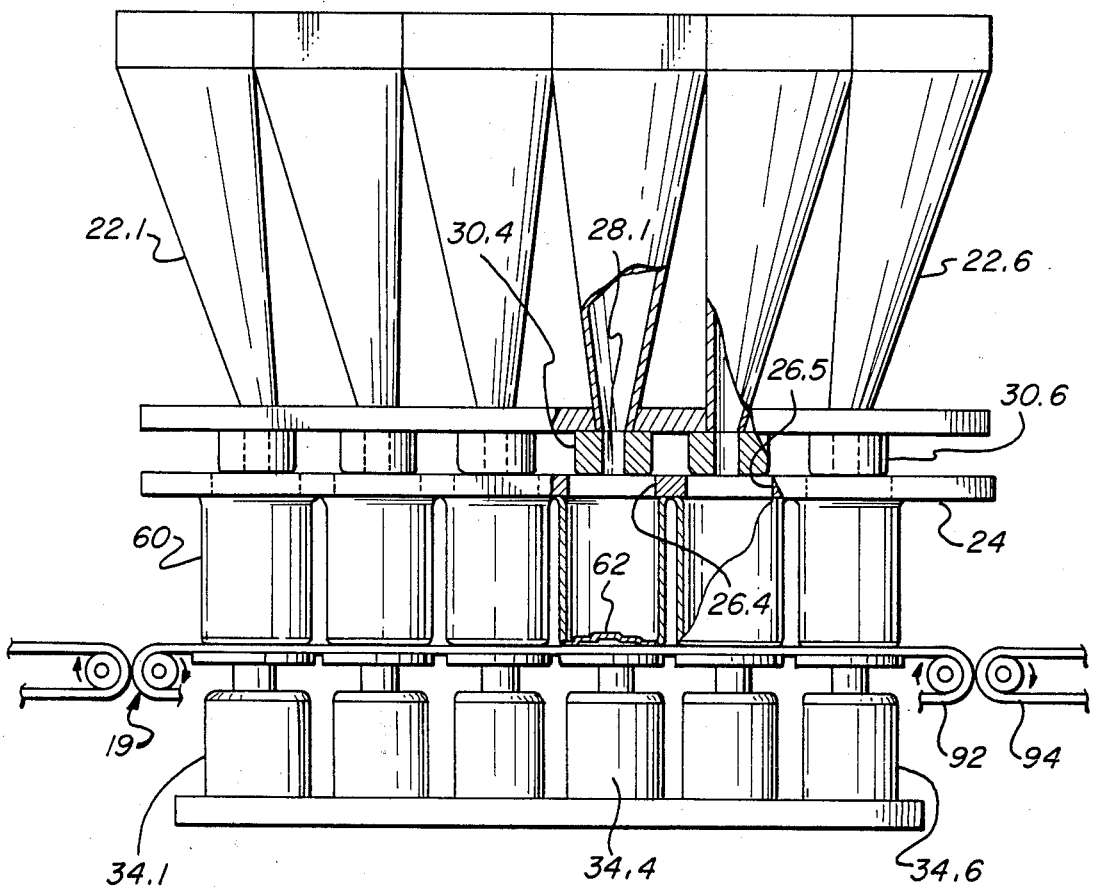
FIG. 4 is a partial front view in elevation of a coffee weighing and filling station in accordance with the invention and used at a ground coffee vacuum packing production line.

As previously mentioned, in a production line a number of coffee cans are simultaneously filled with predetermined amounts of ground coffee. That is done as shown in FIG. 4 with a multiple can filling machine to which empty coffee can 10 or 60 are delivered. When the proper number of cans are in place, a mechanism that is not shown but well-known, operates to dispense predetermined amounts of ground coffee through funnels 22 and pistons 30 into the cans. The actuators 34 are simultaneously operated to compress the ground coffee. After this cycle is completed, the now-filled coffee cans are moved away by a conveyor 92 onto a subsequent conveyor 94.

Having thus described several embodiments of the invention, its advantages can be understood. Variations can be made. For example, the coffee cans may be made of plastic materials and the compression of ground coffee could be done by moving the piston instead of the coffee can. Other granular materials than coffee can be so packed. It is also apparent that other types of filling equipment (i.e. - volume fillers) can be used with this invention.

What is claimed is:

1. A method for placing a predetermined amount by weight of ground coffee into an open-ended container that is sized to hold such amount for subsequent vacuum packing, comprising the steps of:

supplying prior to said vacuum packing, along a feed path, the open end of the container with said predetermined amount by weight of ground coffee whose density may be at any value within a predetermined density range and storing part of said predetermined amount of ground coffee outside the container in a column that rests upon the ground coffee inside the container;

compressing the ground coffee that is in the column to a predetermined head level in the container; and during this compressing step, expanding the volume of the container to accommodate a wide range of different ground coffee densities.

2. The method as claimed in claim 1 wherein the supplying step supplies ground coffee whose standard density may be at any value within a density range that extends from about 17.5 to about 22 lbs./ft$^3$.

3. The method as claimed in claim 2 wherein the compression step comprises compressing ground coffee in a region that effectively surrounds the feed path while having a portion of the ground coffee that is in the feed path remain outside the container, and gravity feeding the latter portion of ground coffee to the container after completion of the compression step.

4. The method as claimed in claim 3 wherein the compression step comprises compressing an annular region of the column of ground coffee into the container and leaving said portion in a column that is central relative to the annular compressed region.

5. The method as claimed in claim 1 wherein said volume-expanding step expands the volume by moving a container end outwardly.

6. A method for placing a predetermined amount by weight of ground coffee into open-ended coffee cans that are each sized to hold such amount for subsequent vacuum packing comprising the steps of:

transporting a sequence of open empty coffee cans to a ground coffee weighing and filling station;

supplying prior to vacuum packing, along a feed path, to the coffee cans at the latter station while vibrating the cans, a predetermined amount by weight of ground coffee whose density may be at any value within a predetermined density range and storing portions of said predetermined amount of ground coffee outside the cans in columns that rest upon the ground coffee that is in the cans;

compressing peripherally located portions of the columns of ground coffee to a predetermined head level in the coffee cans, at said station by compressing most of the ground coffee columns around the feed paths while leaving uncompressed ground coffee column portions in the feed path; and delivering the uncompressed ground coffee column portions into the respective cans after completing the compression step.

7. The method as claimed in claim 6 wherein said columns of ground coffee are stored in columns whose crossectional dimensions are substantially that of the respective coffee cans.

8. The method as claimed in claim 6 wherein said compression step includes:

expanding the volume of the coffee cans during said compression to accommodate a wide range of different ground coffee densities.

9. The method as claimed in claim 8 wherein said ground coffee being supplied to the coffee cans has a density that lies in the range from about 17 to about 22 lbs. per cubic foot.

10. A method for placing a predetermined amount by weight of ground coffee into an open-ended container that is sized to hold such amount for subsequent vacuum packing, comprising the steps of:

supplying, along a feed path, the open end of the container with said predetermined amount by weight of ground coffee whose density may be at any value within a predetermined density range and storing part of said predetermined amount of ground coffee having a low density outside the container in a column that rests upon the ground coffee inside the container;

compressing a peripherally located portion of the ground coffee that is in the column into the container while a portion of said column of ground coffee is uncompressed and is still outside the container, and compressing said peripherally located portion of ground coffee to an extent so as to provide internal container space that is sized to accommodate, after compression and substantially without spillage, the portion of ground coffee that is umcompressed and outside the container, said coffee compression being kept sufficiently low to avoid excessive compression of the ground coffee inside said container; and delivering said uncompressed ground coffee column portion into the container after the compressing step.

11. The method as claimed in claim 10 wherein the supplying step supplies ground coffee whose standard density may be at any value within a density range that extends from about 17.5 to about 2 lbs./ft$^3$.

12. The method as claimed in claim 11 wherein the compression step comprises compressing ground coffee to a predetermined head level in the container.

13. The method as claimed in claim 12 wherein the compression step comprises compressing an annular region of ground coffee inside the container and storing said column portion at the location that is central relative to the annular compressed region.

14. The method as claimed in claim 11 wherein said column of coffee is stored in a column whose crossectional dimensions are substantially that of the container.

15. The method as claimed in claim 10 wherein the compression step includes:

expanding the volume of the container during said compression to accommodate a wide range of different ground coffee densities.

16. The method as claimed in claim 15 wherein said volume-expanding step expands the volume by moving a container end outwardly.

17. A method for placing a predetermined amount by weight of ground coffee into open-ended coffee cans that are each sized to hold such amount for subsequent vacuum packing comprising the steps of:

transporting a sequence of open empty coffee cans to a ground coffee weighing and filling station;

supplying, to the coffee cans at the latter station and along feed paths, a predetermined amount by weight of ground coffee whose density may be at any value within a predetermined density range and storing part of said predetermined amount of ground coffee having a low density outside the cans in columns that rest upon the ground coffee inside the cans;

compressing a peripherally located portion of the ground coffee, that is inside and above a predetermined head level in the coffee cans, at said station while column portions of said predetermined amount of ground coffee for the coffee cans are left uncompressed outside the coffee cans and at said station, and compressing said peripherally located portion of ground coffee in the coffee cans to the head level; and gravity feeding said uncompressed column portions that are outside the coffee cans into the respective cans after completing the compression step whereby the ground coffee can be transported inside the cans substantially without spillage of ground coffee.

18. The method as claimed in claim 17 wherein said compression step is applied to a region that extends around the feed paths.

19. The method as claimed in claim 18 wherein said compression step compresses annular regions of the ground coffee, said regions surrounding the columns of ground coffee.

20. The method as claimed in claim 17 wherein said compression step includes:

expanding the volume of the coffee cans during said compression to accommodate a wide range of different ground coffee densities.

21. The method as claimed in claim 20 wherein said ground coffee being supplied to the coffee cans has a density that lies in the range from about 17 to about 22 lbs. per cubic foot.

22. The method as claimed in claim 21 wherein the volume expanding step expands the coffee can volume by moving an end of the can outwardly.

23. A method for placing a predetermined amount by weight of ground coffee into an open-ended container sized to hold said predetermined weight of coffee, comprising the steps of:

supplying said predetermined amount by weight of ground coffee along a feed path into the container with the density of the ground coffee being at any value within a predetermined density range;

compressing the ground coffee to stiffen the ground coffee for side wall support and during said compression expanding the volume of the container to relieve, during said compression, excessive pressure of the compacted ground coffee so as to enable low density ground coffee to fit into the container.

24. The method as claimed in claim 23, wherein the container volume expanding step includes:

moving a bottom end of the open-ended container outwardly.

25. The method as claimed in claim 24 wherein the volume expansion is in a range whose magnitude is about 15 percent of the volume of the unexpanded container.

26. The method as claimed in claim 23 wherein the supplying step includes, effectively at the conclusion thereof, storing part of said predetermined amount of ground coffee outside the container in a column that rests upon the ground coffee inside the container.

27. The method as claimed in claim 26 wherein a portion of the predetermined amount of ground coffee is stored outside the container during the compression step, and after said compression step, delivering the portion into the container.

28. The method as claimed in claim 27 wherein the ground coffee portion is stored in a column whose cross-sectional dimensions are substantially the same as those of the container.

29. The method as claimed in claim 27 wherein the compression step comprises compressing the ground coffee in a region that surrounds the feed path.

30. In a method for producing a vacuum packed ground coffee container having a side wall, the improvement comprising the steps of:

supplying a desired amount by weight of ground coffee to a container so as to fill it above a predetermined fill level of the container;

compressing the ground coffee to bring its top substantially at the predetermined level and, during said compression step, expanding the volume of the container to avoid excessive rigidizing of the ground coffee while sufficiently compressing the ground coffee to a magnitude where the side wall of the container is supported by compressed coffee against collapse when a vacuum is drawn inside the container.

31. The improved method as claimed in claim 30 wherein the container has a bottom and the expanding step comprises the step of:

forcing the bottom of the container to move outwardly.

32. The improved method as claimed in claim 30 wherein the ground coffee has a density that falls within a predetermined range with the applying step being done so that the top of the ground coffee, when it has a density at the high end of the range, is above said predetermined fill level so as to enable sufficient compression of the ground coffee, and, when it has a density at the low end of the range, enabling sufficient expansion of the volume of the container to avoid excessive rigidizing of the ground coffee.

33. The improved method as claimed in claim 32 wherein the density of the ground coffee is in the range from 17 to about 22 lbs./ft$^3$.

* * * * *